US006171345B1

(12) United States Patent
Convents et al.

(10) Patent No.: US 6,171,345 B1
(45) **Date of Patent: *Jan. 9, 2001**

(54) DETERGENT COMPOSITIONS

(75) Inventors: Daniel Convents, Merelbeke (BE); Cornelis Theodorus Verrips, Maassluis (NL)

(73) Assignee: Lever Brothers Company, division of Conopco, Inc., New York, NY (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/982,806

(22) Filed: Jun. 25, 1997

(30) Foreign Application Priority Data

Jul. 5, 1996 (EP) ..... 96201872

(51) Int. Cl.[7] ..... C11D 3/302

(52) U.S. Cl. ..... 8/137; 435/263; 510/281; 510/320; 510/392; 510/530

(58) Field of Search ..... 8/137; 435/263; 510/281, 320, 530, 392

(56) References Cited

U.S. PATENT DOCUMENTS

| | | | | |
|---|---|---|---|---|
| 4,111,854 | | 9/1978 | Spadini et al. | 252/541 |
| 5,273,896 | * | 12/1993 | Pederson et al. | 435/192 |
| 5,389,307 | * | 2/1995 | Lindegaard et al. | 252/549 |
| 5,605,832 | * | 2/1997 | Damhus et al. | 435/263 |
| 5,648,262 | * | 7/1997 | Damhus et al. | 435/263 |
| 5,700,770 | * | 12/1997 | Damhus et al. | 510/305 |
| 5,712,153 | * | 1/1998 | Damhus et al. | 435/263 |

FOREIGN PATENT DOCUMENTS

| | | |
|---|---|---|
| 195 41 556 | 5/1997 | (DE) . |
| 2 264 085 | 10/1975 | (FR) . |
| WO 95/31534 | 11/1995 | (WO) . |

OTHER PUBLICATIONS

*Principles of Biochemistry*, Lehinger, Chapter 8 pp. 171–172, (1982).*

* cited by examiner

*Primary Examiner*—Kery Fries
(74) *Attorney, Agent, or Firm*—Rimma Mitelman

(57) ABSTRACT

There is provided a detergent composition comprising one or more surfactants and a compound capable of binding to coloured substances which may occur as stains on fabrics.

9 Claims, No Drawings

DETERGENT COMPOSITIONS

TECHNICAL FIELD

The present invention generally relates to the field of detergent and cleaning compositions. More in particular, the invention is concerned with a composition and a process for cleaning fabrics.

BACKGROUND AND PRIOR ART

Conventional modern detergent compositions for washing fabrics are complex mixtures of ingredients which act to remove soil from the fabric during the washing process. Such compositions comprise one or more surface active agents or surfactants which act to lower the surface tension of the washing solution, thus enabling the dissolution or dispersion of soil into the washing solution. The oldest example of such a surfactant is soap which was already used by the ancient Egyptians.

A significant improvement in the cleaning performance of detergent compositions was obtained by the addition of so-called builders, which enhance the cleaning action of the composition by complexing calcium ions which are present in hard water. Examples of such builders are sodium tripolyphosphate (STP), nitrilotriacetate (NTA) and zeolite.

A further significant improvement in the performance of detergent compositions was achieved by the addition of bleaching systems which react chemically with stains present on the fabrics and thereby decolorize the stains. Examples of efficient bleaching systems are tetra acetyl ethylene diamine (TAED)/sodium perborate, and sodium nonanoyloxybenzene sulphonate (SNOBS).

Another significant improvement in the performance of detergent compositions was achieved by the addition of enzymes to detergent compositions. The use of protease in fabric washing compositions is most wide spread, whereas lipases, amylases and cellulases are used less frequently.

Although each of the above improvements has been successful to a certain extent, there is still a need to provide alternative or further improved detergent compositions. In particular, there is a need for effective cleaning action against specific coloured stains which are often difficult to remove. It is therefor an object of the present invention to provide effective alternative or improved detergent compositions for fabric washing. It is a further object of the present invention to provide an effective alternative or improved process for washing fabrics.

We have now surprisingly found that these and other objects can be achieved by the detergent compositions of the invention, which are characterized in that they comprise one or more surfactants and a compound which is capable of binding to a coloured substance which may occur as stains on fabrics.

DEFINITION OF THE INVENTION

According to a first aspect of the invention, there is provided a detergent composition comprising one or more surfactants and a compound which is capable of binding to a coloured substance which may occur as stains on fabrics. According to a second aspect, there is provided a process for removing coloured stains from a fabric, characterized by treating the fabric with detergent composition comprising one or more surfactants and a compound which is capable of binding to a coloured substance present in said coloured stain.

DESCRIPTION OF THE INVENTION

The detergent composition of the present invention comprises (a) one or more surface active agents or surfactants and (b) a compound capable of binding to a coloured substance which may occur as stains on fabrics and, optionally, (c) conventional detergent ingredients.

(a) The Surfactant

The detergent compositions according to the invention comprise, as a first constituent, one or more detergent-active compounds (surfactants) which may be chosen from soap and non-soap anionic, cationic, nonionic, amphoteric and zwitterionic detergent-active compounds, and mixtures thereof. Many suitable detergent-active compounds are available and are fully described in the literature, for example, in "Surface-Active Agents and Detergents", Volumes I and II, by Schwartz, Perry and Berch.

The preferred detergent-active compounds that can be used are soaps and synthetic non-soap anionic and nonionic compounds. The detergent composition may comprise both nonionic and anionic surfactant, it is preferred if the ratio of nonionic surfactant to anionic surfactant is at least 1 to 3, more preferably at least 1 to 1.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. The sodium salts of these surfactants are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamides).

The choice of detergent-active compounds (surfactant), and the amount present, will depend on the intended use of the detergent composition. In fabric washing compositions intended for use in washing machines, as is well known to the skilled formulator, different surfactant systems may be chosen than for products intended for handwashing. The total amount of surfactant present will also depend on the intended end use and may be as high as 60% by weight of the total composition, for example, in a composition for washing fabrics by hand. In compositions for machine washing of fabrics, an amount of from 5 to 40% by weight is generally appropriate, especially from 10 to 30% by weight.

Detergent compositions suitable for use in most automatic fabric washing machines generally contain anionic non-soap surfactant, or nonionic surfactant, or combinations of the two in any ratio, optionally together with soap.

b) Compound Capable of Binding to a Coloured Substance

The novel cleaning composition according to the present invention is based on the presence of a compound capable of binding a coloured substance, or pigment, which may occur in stains. The degree of binding of a compound A to another molecule B can be generally expressed by the chemical equilibrium constant $K_d$ resulting from the following binding reaction:

$$[A]+[B] \leftrightarrows [A::B] \quad (1)$$

The chemical equilibrium constant $K_d$ is then given by:

$$K_d = \frac{[A] \times [B]}{[A::B]}$$

Whether the binding to a coloured substance in a stain is specific or not can be judged from the difference between the binding ($K_d$ value) of the compound to that coloured substance, versus the binding to material to which that substance is applied. For substances which occur in stains, the latter material can be envisioned to be the fabric on which the stain is present. The difference between the two binding constants should be minimally 100, and preferably more that 1000. Typically, the compound should bind the coloured substance with a $K_d$ value of $1*10^{-5}$–$1*10^{-6}$, with a background binding to fabric with a $K_d$ of $1*10^{-2}1*10^{-3}$. Higher binding affinities ($K_d$ of less than $1*10^{-5}$) and/or a larger difference between coloured substance and background binding would increase the stain removal performance. Also, the weight efficiency of the compound in the total detergent composition would be increased and smaller amounts of the compound would be required.

Several classes of compounds can be envisaged which deliver the capability of specific binding to, a coloured substance. In the following we will give a number of examples of such compounds having such capabilities, without pretending to be exhaustive.

Antibodies

Antibodies are well known examples of compounds which are capable of binding specifically to compounds against which they were raised. Antibodies can be derived from several sources. From mice, monoclonal antibodies can be obtained which possess very high binding affinities. From such antibodies, Fab, Fv or scFv fragments, can be prepared which have retained their binding properties. Such antibodies or fragments can be produced through recombinant DNA technology by microbial fermentation. Well known production hosts for antibodies and their fragments are yeast, moulds or bacteria.

A class of antibodies of particular interest is formed by the Heavy Chain antibodies as found in Camelidae, like the camel or the llama. The binding domains of these antibodies consist of a single polypeptide fragment, namely the variable region of the heavy chain polypeptide (HC-V). In contrast, in the classic antibodies (murine, human, etc.), the binding domain consist of two polypeptide chains (the variable regions of the heavy chain ($V_h$) and the light chain ($V_1$)). Procedures to obtain heavy chain immunoglobulins from Camelidae, or (functionalized) fragments thereof, have been described in WO-A-94/04678 (Casterman and Hamers) and WO-A-94/25591 (Unilever and Free University of Brussels).

Alternatively, binding domains can be obtained from the $V_h$ fragments of classical antibodies by a procedure termed 'camelization'. Hereby the classical $V_h$ fragment is transformed, by substitution of a number of amino acids, into a HC-V-like fragment, whereby its binding properties are retained. This procedure has been described by Riechmann et al. in a number of publications (J. Mol. Biol. (1996), 259, 5, 957–69; Protein. Eng. (1996), 9, 6, 531–37, Bio/Technology, (1995) 13, 5, 475–79). Also HC-V fragments can be produced through recombinant DNA technology in a number of microbial hosts (bacterial, yeast, mould), as described in WO-A-94/29457 (Unilever).

Peptides

Peptides usually have lower binding affinities to the substances of interest than antibodies. Nevertheless, the experiments described in the examples show that the binding properties of peptides can be sufficient for the desired stain removal process. A peptide which is capable of binding to a coloured substance can for instance be obtained from a protein which is known to bind to that specific coloured substance. The peptide sequence can then be obtained by extracting it from the protein known to bind to the coloured substance. In the following Examples we have used a heme binding peptide which has been obtained by this procedure. Its sequence—YAKRCPVDHTM (in the one letter amino acid code)—was obtained from proteins which bind heme for the regulation of the activity of the protein (Heme regulatory sequence, (EMBO Journal (1995) vol. 12 no 2, 313–320).

Alternatively, peptides which bind to coloured substances can be obtained by the use of peptide combinatorial libraries. Such a library may contain up to $10^{10}$ peptides, from which the peptide with the desired binding properties can be isolated. (R. A. Houghten, Trends in Genetics, Vol 9, no &, 235–239). Several embodiments have been described for this procedure (J. Scott et al., Science (1990), Vol. 249, 386–390; Fodor et al., Science (1991), Vol. 251, 767–773; K. Lam et al., Nature (1991) Vol. 354, 82–84; R. A. Houghten et al., Nature (1991) Vol. 354, 84–86).

Suitable peptides can be produced by organic synthesis, using for example the Merrifield procedure (Merrifield, J.Am.Chem.Soc. (1963), 85, 2149–2154). Alternatively, the peptides can be produced by recombinant DNA technology in microbial hosts (yeast, moulds, bacteria) (K. N. Faber et al., Appl. Microbiol. Biotechnol. (1996) 45, 72–79).

Pepidomimics

In order to improve the stability and/or binding properties of a peptide, the molecule can be modified by the incorporation of non-natural amino acids and/or non-natural chemical linkages between the amino acids. Such molecules are called peptidomimics (H. U. Saragovi et al. Bio/Technology (1992), Vol 10, 773–778; S. Chen et al., Proc.Natl.Acad.Sci. USA (1992) Vol 89, 5872–5876). The production of such compounds is restricted to chemical synthesis.

Other Organic Molecules

It can be readily envisaged that other molecular structures, which need not be related to proteins, peptides or derivatives thereof, can be found which bind coloured substances with the desired binding properties. For example, certain polymeric RNA molecules which have been shown to bind small synthetic dye molecules (A. Ellington et al., Nature (1990) vol. 346, 818–822). Such binding compounds can be obtained by the combinatorial approach, as described for peptides (L. B. McGown et al., Analytical Chemistry, Nov. 1, 1995, 663A–668A).

This approach can also be applied for purely organic compounds which are not polymeric. Combinatorial procedures for synthesis and selection for the desired binding properties have been described for such compounds (Weber et al., Angew.Chem.Int.Ed.Engl. (1995), 34, 2280–2282; G. Lowe, Chemical Society Reviews (1995) Vol 24, 309–317; L. A. Thompson et al. Chem. Rev. (1996), Vol. 96, 550–600). Once suitable binding compounds have been identified, they can be produced on a larger scale by means of organic synthesis.

The Colored Substances

There are several types or classes of coloured substances which may occur in stains on fabrics which can be envisaged. A number of examples is given below:

1. Porphyrin Derived Structures

Porphyrin structures, often coordinated to a metal, form one class of coloured substances which occur in stains.

Examples are heme or haematin in blood stain, chlorophyll as the green substance in plants, e.g. grass or spinach. Another example of a metal-free substance is bilirubin, a yellow coloured breakdown product of heme.

2. Tannins, Polyphenols

Tannins are polymerised forms of certain classes of polyphenols. Such polyphenols are catechins, leuantocyanins, etc. (P. Ribereau-Gayon, Plant Phenolics, Ed. Oliver & Boyd, Edinburgh, 1972, pp.169–198). These substances can be conjugated with simple phenols like e.g. gallic acids. These polyphenolic substances occur in tea stains, wine stains, banana stains, peach stains, etc. and are notoriously difficult to remove.

3. Carotenoids (G. E. Bartley et al., The Plant Cell (1995), Vol 7, 1027–1038). Carotenoids are the coloured substances which occur in tomato (lycopene, red), mango (β-carotene, orange-yellow). They occur in food stains (tomato) which are also notoriously difficult to remove, especially on coloured fabrics, when the use of chemical bleaching agents is not advised.

4. Anthocyanins (P. Ribereau-Gayon, Plant Phenolics, Ed. Oliver & Boyd, Edinburgh, 1972, 135–169). These substance are the highly coloured molecules which occur in many fruits and flowers. Typical examples, relevant for stains, are berries, but also wine. Anthocyanins have a high diversity in glycosidation patterns.

5. Maillard Reaction products

Upon heating of mixtures of carbohydrate molecules in the presence of protein/peptide structures, a typical yellow/brown coloured substance arises. These substances occur for example in cooking oil and are difficult to remove from fabrics.

(c) Optional Further Ingredients

Among the optional further ingredients of the detergent composition of the present invention, the following can be envisaged:

(c1) Detergency Builders

The detergent compositions of the invention will generally also contain one or more detergency builders. This detergency builder may be any material capable of reducing the level of free calcium ions in the wash liquor and will preferably provide the composition with other beneficial properties such as the generation of an alkaline pH, the suspension of soil removed from the fabric and the suspension of the fabric-softening clay material. The total amount of detergency builder in the compositions will suitably range from 5 to 80 wt %, preferably from 10 to 60 wt %. Inorganic builders that may be present include sodium carbonate, if desired in combination with a crystallisation seed for calcium carbonate, as disclosed in GB-A-1 437 950 (Unilever); crystalline and amorphous aluminosilicates, for example, zeolites as disclosed in GB-A-1 473 201 (Henkel), amorphous aluminosilicates as disclosed in GB-A-1 473 202 (Henkel) and mixed crystalline/amorphous aluminosilicates as disclosed in GB-A-1 470 250 (Procter & Gamble); and layered silicates as disclosed in EP-B-164 (Hacksawed). Inorganic phosphate builders, for example, sodium orthophosphate, pyrophosphate and tripolyphosphate, may also be present, but on environmental grounds those are no longer preferred.

The detergent compositions of the invention preferably contain an alkali metal, preferably sodium, aluminosilicate builder. Sodium aluminosilicates may generally be incorporated in amounts of from 10 to 70% by weight (anhydrous basis), preferably from 25 to 50 wt %. The alkali metal aluminosilicate may be either crystalline or amorphous or mixtures thereof, having the general formula:

$$0.8–1.5\ Na_2O.\ Al_2O_3.\ 0.8–6\ SiO_2$$

These materials contain some bound water and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature.

Suitable crystalline sodium aluminosilicate ion-exchange detergency builders are described, for example, in GB-A-1 429 143 (Proctor & Gamble). The preferred sodium aluminosilicates of this type are the well-known commercially available zeolites A and X, and mixtures thereof. The zeolite may be the commercially available zeolite 4A now widely used in laundry detergent powders. However, according to a preferred embodiment of the invention, the zeolite builder incorporated in the compositions of the invention is maximum aluminium zeolite P (zeolite MAP) as described and claimed in EP-A-384 070 (Unilever). Zeolite MAP is defined as an alkali metal aluminosilicate of the zeolite P type having a silicon to aluminium ratio not exceeding 1.33, preferably within the range of from 0.90 to 1.33, and more preferably within the range of from 0.90 to 1.20. Especially preferred is zeolite MAP having a silicon to aluminium ratio not exceeding 1.07, more preferably about 1.00. The calcium binding capacity of zeolite MAP is generally at least 150 mg Cao per g of anhydrous material.

Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyl-iminodiacetates, alkyl- and alkenylmalonates and succinates; and sulphonated fatty acid salts. This list is not intended to be exhaustive. Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in the form of their alkali metal salts, especially their sodium salt.

(c2) Other Ingredients

The detergent compositions of present invention may also comprise, in further embodiments, combinations with other constituents normally used in detergent systems, including additives for detergent compositions. Such other components can be any of many known kinds, for example enzymes, enzyme stabilizers, lather boosters, soil-suspending agents, soil-release polymers, hydrotropes, corrosion inhibitors, dyes, perfumes, silicates, optical brighteners, suds depressants, germicides, anti-tarnishing agents, opacifiers, fabric softening agents, buffers and the like.

Examples are described in GB-A-1 372 034 (Unilever), U.S. Pat. No. 3,950,277, U.S. Pat. No. 4,011,169, EP-A-179 533 (Proctor & Gamble), EP-A-205 208 and EP-A-206 390 (Unilever), JP-A-63-078000 (1988), and Research Disclosure 29056 of June 1988. The formulation of detergent compositions according to the invention can be also illustrated by reference to the Examples D1 to D14 of EP-A-407 225 (Unilever).

Special advantage may be gained in such detergent compositions wherein a proteolytic enzyme or protease is also present. Proteases for use in the compositions of the invention may include subtilisins of, for example, BPN' type or of many of the types of subtilisin disclosed in the literature, some of which have already been proposed for detergents use, e.g. mutant proteases as described in for example EP-A-130 756 or EP-A-251 446 (both Genentech), U.S. Pat. No. 4,760,025 (Genencor), EP-A-214 435 (Henkel), WO-A-87/04661 (Amgen), WO-A-87/05050 (Genex), Thomas et al. (1986) in Nature 5, 316, and 5, 375–376 and in J.Mol-.Biol. (1987) 193, 803–813, Russel et al. (1987) in Nature 328, 496–500, and others.

Furthermore, certain polymeric materials such as polyvinyl pyrrolidones typically having a MW of 5,000 to 20,000 are useful ingredients for preventing the transfer of labile dye stuffs between fabrics during the washing process. Especially preferred are ingredients which also provide colour care benefits. Examples hereof are polyamide-N-oxide containing polymers.

The detergent composition according to the present invention may in principle take any suitable physical form, such as a powder, an aqueous or non-aqueous liquid, a paste or a gel. However, granular detergents (powders) are preferred.

The invention will now be further illustrated in the following non-limiting Examples.

EXAMPLE 1

The Soil Removing Potential of Recognitive Peptides.

The soil removing potential of recognitive peptides was assessed by washing a swatch soiled with hematin with an hematin binding peptide. A peptide capable of binding to heme was obtained from a heme binding protein. Its sequence—YAKRCPVDHTM (one letter amino acid code)—was obtained from proteins which bind heme for the regulation of the activity of the protein (Heme regulatory sequence, (EMBO Journal (1995) vol. 12 no 2, 313–320).

The swatches were soiled using the following procedures:

1. A 1 mM stock solution of hematin was prepared in an Aceton/HCl (5% v/v) solution. 100 μl of this solution was applied onto a 5 cm×5 cm cotton swatch.

2. Alternatively, hematin was solubilized in 0.02 N NaOH. Soiling was carried out as above. The swatches were stored overnight at 20° C., 60% humidity, in the dark. Varying amounts of hematin binding peptide were added to the wash solution: 10 μM, 25 μM, 50 μM, and 100 μM. A control wash was done without peptide added. The fabrics were agitated in the wash solution, 20 mM carbonate buffer (25 ml) for 30 minutes at 30° C. The swatches were line dried and the reflectance spectra were measured using a Minolta spectrometer. The data thereby obtained were transferred to the CIELAB L*a*b* colour space parameters. In this colour space, L* indicates lightness and a* and b* are the chromaticity coordinates.

The colour differences between the swatches prior to washing and after the wash, were expressed as ΔE, calculated from the following equation:

$$(\Delta E)=\sqrt{(\Delta L)^2+(\Delta a)^2+(\Delta b)^2}$$

The whiteness (ΔL) and the colour difference (ΔE) obtained by the above method are given below in Table 1.

TABLE 1

| wash conditions: | ΔL | ΔE |
|---|---|---|
| hematin solubilized in Aceton/HCl, peptide added: | | |
| 0 μM | 3.4 | 7.0 |
| 10 μM | 6.3 | 8.3 |
| 25 μM | 8.7 | 10.3 |
| 50 μM | 9.3 | 11.0 |
| 100 μM | 9.9 | 11.4 |
| hematin solubilized in 0.02N NaOH, peptide added: | | |
| 0 μM | 7.5 | 11.1 |
| 10 μM | 9.7 | 12.3 |
| 25 μM | 14.9 | 18.8 |
| 50 μM | 14.8 | 18.9 |
| 100 μM | 15.5 | 19.7 |

Clearly, addition of the hematin binding peptide results in the increased removal of hematin from the swatch. In order to exclude the possibility of non-recognitive, reductive bleaching of the hematin soiling, experiments were performed as above in the presence of free cysteine. The results are given in Table 2 below:

TABLE 2

| wash conditions: | ΔL | ΔE |
|---|---|---|
| hematin solubilized in Aceton/HCl, cysteine added: | | |
| 0 μM | 3.5 | 7.0 |
| 25 μM | 4.2 | 7.0 |
| 50 μM | 4.4 | 7.4 |
| 100 μM | 3.8 | 6.9 |
| hematin solubilized in 0.02N NaOH, cysteine added: | | |
| 0 μM | 7.5 | 11.1 |
| 25 μM | 10.0 | 12.6 |
| 50 μM | 9.3 | 11.3 |
| 100 μM | 8.6 | 10.8 |

No significant removal of hematin can be noticed when cysteine is added to the wash solution. This demonstrates that non-specific reductive bleach is not the mechanism by which the soil is removed. The hematin binding property of the peptide provokes the removal process.

EXAMPLE 2

The Soil Removing Potential of Recognitive Peptides in Detergent Conditions.

The soil removing potential of recognitive peptides was assessed by washing a swatch soiled with hematin with the same hematin binding peptide as used in Example 1, having the sequence YAKRCPVDHTM (one letter amino acid code). The wash conditions were as in Example 1, except that surfactants were added to the wash solution. These were 0.6 g/l LAS and 0.29 g/l LAS, 1.05 g/l Synperonic A7, respectively. Peptide concentration was 100 μM. The swatches were analyzed as in Example 1. The results are given below in Table 3.

TABLE 3

| Results: | | |
|---|---|---|
| wash conditions | ΔL | ΔE |
| buffer | 4.6 | 7.8 |
| buffer + peptide | 11.1 | 12.8 |
| LAS | 4.9 | 8.2 |
| LAS + peptide | 11.4 | 13.1 |
| LAS/nonionic | 12.4 | 14.3 |
| LAS/nonionic + peptide | 13.5 | 15.6 |

Clearly, the cleaning benefit of the peptide remains present in both surfactant systems.

EXAMPLE 3

The Soil Removing Potential of Recognitive Peptides on Blood Stains.

In order to determine whether the hematin binding properties of the peptide result in a cleaning benefit on real stains, swatches soiled with blood were washed. In a first cycle, the swatches were prewashed in the presence of different amounts of the detergent protease Savinase (Ex Novo Nordisk A/S). Control experiments were done with blood stains which were not prewashed, or prewashed without Savinase. The prewash was done in a carbonate buffer, pH 9. In a second wash cycle, the swatches were washed in the presence of 100 $\mu$M peptide, with and without detergent added (0.6 wt. % LAS) The remaining experimental conditions, and analysis of the swatches were as in Example 1. The results are given below in Table 4.

TABLE 4

| wash condition | ΔL | ΔE |
|---|---|---|
| no prewash | | |
| buffer | 37.8 | 39.7 |
| buffer + peptide | 40.0 | 42.0 |
| LAS | 37.7 | 39.1 |
| LAS + peptide | 41.6 | 43.9 |
| prewash without Savinase | | |
| buffer | 1.0 | 2.0 |
| buffer + peptide | 2.2 | 3.8 |
| LAS | 1.1 | 2.1 |
| LAS + peptide | 2.7 | 3.8 |
| prewash with 20 GU/ml Savinase | | |
| buffer | 0.8 | 1.5 |
| buffer + peptide | 2.9 | 4.4 |
| LAS | 1.2 | 2.5 |
| LAS + peptide | 2.2 | 3.6 |
| prewash with 160 GU/ml Savinase | | |
| buffer | 1.3 | 1.9 |

TABLE 4-continued

| wash condition | ΔL | ΔE |
|---|---|---|
| buffer + peptide | 2.7 | 4.9 |
| LAS | 1.7 | 3.4 |
| LAS + peptide | 2.4 | 4.5 |
| prewash with 500 GU/ml Savinase | | |
| buffer | 1.5 | 2.6 |
| buffer + peptide | 3.4 | 6.0 |
| LAS | 2.3 | 3.8 |
| LAS + peptide | 3.4 | 5.8 |

A clear benefit of the peptide is still apparent on blood stain. This benefit is not dependent on the prewash conditions or the dose of Savinase added in the first wash cycle.

What is claimed is:

1. A detergent composition comprising the following:

(A) one or more surfactants;

(B) a hematin binding peptide which includes an amino acid sequence YAKRCPVDHTM wherein said peptide is capable of selectively binding to a colored substance selected from the group consisting of porphyrin derived structures, tannins, polyphenols, carotenoids, anthocyanins, and maillard reaction products and wherein said binding takes place during a wash cycle that includes agitation.

2. A detergent composition according to claim 1 wherein said peptide is capable of selectively binding to a colored substance which may occur as stain on fabrics.

3. A detergent composition according to claim 1 wherein the amount of peptide capable of binding to colored substance is from 0.001% to 10% of the composition.

4. A detergent composition according to claim 1 wherein said detergent composition further comprises an enzyme.

5. A detergent composition according to claim 4 wherein said enzyme is a subtilisin protease.

6. A detergent composition according to claim 1 wherein said detergent composition is in the form of a granular detergent composition.

7. A detergent composition according to claim 1 wherein said peptide is capable of binding to a colored substrate in an amount of 0.01 to 1% of the composition.

8. A detergent composition according to claim 4 wherein said enzyme is a proteolytic enzyme.

9. A method of removing stains from fabrics comprising contacting at least a portion of a stained fabric with the composition according to claim 1.

* * * * *